US009281568B1

(12) United States Patent
Tonn

(10) Patent No.: US 9,281,568 B1
(45) Date of Patent: Mar. 8, 2016

(54) APPARATUS AND METHOD FOR IMPROVING THE GAIN AND BANDWIDTH OF A MICROSTRIP PATCH ANTENNA

(71) Applicant: David A. Tonn, Amston, CT (US)

(72) Inventor: David A. Tonn, Amston, CT (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 291 days.

(21) Appl. No.: 14/040,810

(22) Filed: Sep. 30, 2013

(51) Int. Cl.
*H01Q 15/12* (2006.01)

(52) U.S. Cl.
CPC ..... *H01Q 15/12* (2013.01)

(58) Field of Classification Search
CPC ..... H01Q 19/06; H01Q 15/02
USPC ..... 343/753, 755, 909
See application file for complete search history.

(56) References Cited

U.S. PATENT DOCUMENTS

2003/0214439 A1* 11/2003 Huebner ..... H01Q 15/242 343/700 MS
2011/0175779 A1* 7/2011 Ju ..... H01Q 1/38 343/755

* cited by examiner

*Primary Examiner* — Hoang V Nguyen
(74) *Attorney, Agent, or Firm* — James M. Kasischke; Michael P. Stanley

(57) ABSTRACT

A method for improving bandwidth and gain of a microstrip patch antenna and a microstrip patch antenna are provided. The method includes forming a highly anisotropic superstrate, and positioning the highly anisotropic superstrate at a predetermined distance away from the ground plane side of the microstrip patch antenna, increasing the bandwidth of the microstrip patch antenna. The antenna provides a microstrip patch antenna having a highly anisotropic superstrate. The highly anisotropic superstrate can include a spacing layer, a dielectric material positioned on the spacing layer and a plurality of conductive strips disposed on the dielectric layer.

18 Claims, 4 Drawing Sheets

APPARATUS AND METHOD FOR IMPROVING THE GAIN AND BANDWIDTH OF A MICROSTRIP PATCH ANTENNA

STATEMENT OF GOVERNMENT INTEREST

The invention described herein may be manufactured and used by or for the Government of the United States of America for governmental purposes without the payment of any royalties thereon or therefor.

CROSS REFERENCE TO OTHER PATENT APPLICATIONS

None.

BACKGROUND OF THE INVENTION (1) Field of the Invention

The present invention provides methods and apparatus of improving both the gain and the bandwidth of a microstrip patch antenna.

(2) Description of the Prior Art

A patch antenna, also referred to as a rectangular microstrip antenna, is a type of radio antenna with a low profile that can be mounted on a flat surface. The patch antenna includes a flat conductor mounted on a dielectric substrate over a larger conductor, typically referred to as a ground plane. The two metal sheets of the patch antenna form a resonant piece of microstrip transmission line. The patch is designed to have a length of approximately one-half wavelength of the radio waves being transmitted or received. A patch antenna can be constructed using the same technology as that used to make a printed circuit board.

An ordinary patch antenna exhibits resonant behavior characterized by a high Q-factor and a relatively narrow impedance bandwidth on the order of 2-6 percent, depending on the losses in the antenna. Some patch antennas are formed from two stacked patches and are designed to have a double resonance, one corresponding to the L1 frequency (1575 MHz) and the other to the L2 frequency (1227 MHz) commonly used in global positioning systems. FIG. 1 provides an exemplary measured voltage standing wave ratio (VSWR) plot for such an antenna. A first resonance is indicated at L1 and a second resonance is indicated at L2.

Typical patch antennas are tuned to the L1 and L2 GPS commercial frequencies, but they lack performance at the operating frequencies of other desirable services, including new and emerging COMMs bands, such as Iridium™, which typically operates between 1616 MHz and 1626.5 MHz.

Thus, there is a need for antennas that can receive these new bands. There is a further need for adapting existing patch antennas to accommodate additional services operating at these other frequencies.

SUMMARY OF THE INVENTION

Accordingly, it is an object of the present invention to provide a microstrip patch antenna having improved bandwidth and gain.

Another object is to provide method for retrofitting an existing microstrip patch antenna to make an antenna having an improved bandwidth and gain.

Yet another object is to provide a kit that can be used to retrofit an existing microstrip patch antenna.

In view of these objects, there is provided a method for improving bandwidth and gain of a microstrip patch antenna.

A highly anisotropic superstrate is formed and positioned at a predetermined spacing away from the ground plane side of the microstrip patch antenna. A cover layer can be mounted over the highly anisotropic superstrate. The highly anisotropic superstrate can includes a plurality of conductive strips regularly disposed over a dielectric material. In further embodiments, the conductive strips can be provided with a capacitive load region at each end of each conductive strip.

An antenna is further provided including a microstrip patch antenna for mounting on a ground plane and a highly anisotropic superstrate having a predetermined resonance placed at a specific spacing above said microstrip patch antenna in the direction away from the ground plane. A cover layer can be positioned over the highly anisotropic superstrate in the direction away from the ground plan. A spacing layer can be disposed on said microstrip patch antenna in order to maintain the specific spacing between the microstrip patch antenna and the highly anisotropic superstrate. The highly anisotropic superstrate can include a plurality of conductive strips regularly disposed on a dielectric substrate. Each of the conductive strips can be provided with a capacitive load region at each end of each conductive strip. The microstrip patch antenna can be a stacked patch antenna having at least two patches where the highly anisotropic superstrate is positioned at a specific spacing above one of the patches. A kit is further provided for retrofitting an existing patch antenna.

BRIEF DESCRIPTION OF THE DRAWINGS

Other objects, features and advantages of the present invention will become apparent upon reference to the following description of the preferred embodiments and to the drawings, wherein corresponding reference characters indicate corresponding parts throughout the several views of the drawings and wherein.

DETAILED DESCRIPTION OF THE INVENTION

Figure 2:
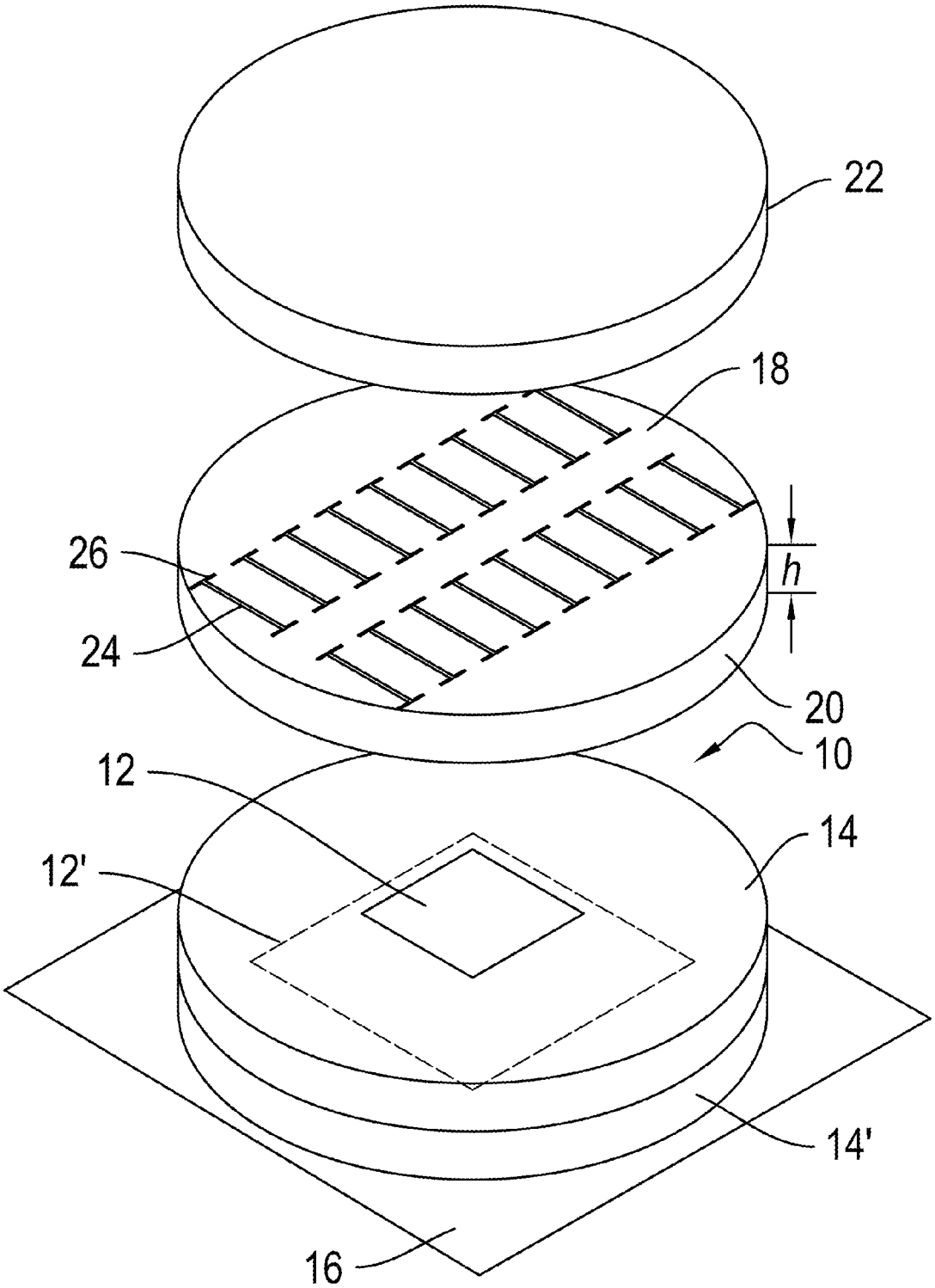
FIG. 2 is an exploded perspective view of a microstrip patch antenna having a highly anisotropic superstrate added thereto.
Figure 3:
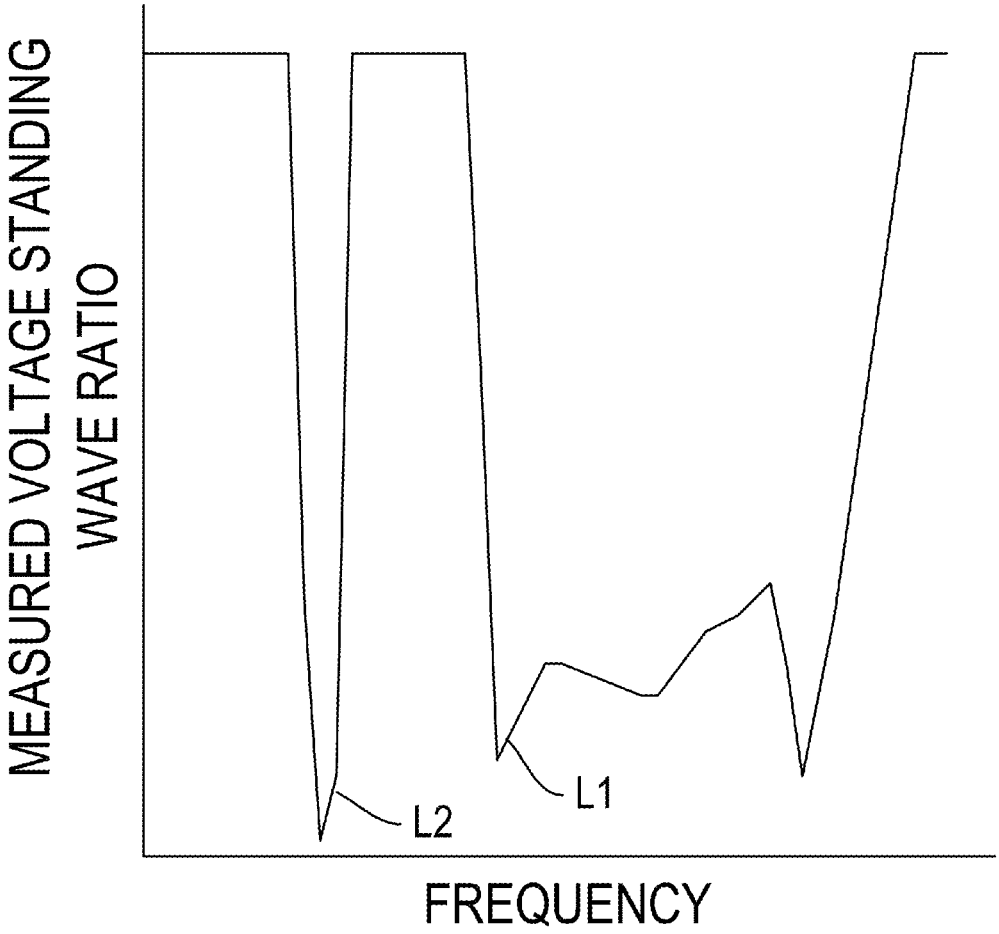
FIG. 3 is a diagram showing a measured voltage standing wave ratio plot of the patch antenna of FIG. 2.

Referring now to the drawings, and more particularly to FIGS. 2 and 3, the present invention provides methods and apparatus for improving both the gain and the bandwidth of a microstrip patch antenna 10.

A microstrip patch antenna 10 includes one or more rectangular conductive surfaces 12, 12' printed on a grounded dielectric substrate 14, 14' and fed by a coaxial probe (not shown) that penetrates the dielectric substrate 14, 14' from beneath. Patch antenna 10, in use, is mounted on a conducting ground plane 16. For purposes of this description, the distance away from the ground plane 16 is referenced as being above the ground plane 16. The patch antenna 10 shown is a stacked patch antenna having two conductive surfaces 12 and 12' and two substrates 14 and 14'. This is used so that the antenna can have two resonances such as at the L1 GPS frequency and at the L2 GPS frequency as is commonly known in the art.

Above this patch antenna 10, at a spacing h, is placed a superstrate 18 of a highly anisotropic superstrate. The spacing, h, can be provided by, for example, a layer of foam 20.

Spacing layer 20 can be made from any material that is effectively transparent to electromagnetic radiation at the operating range of the modified antenna. A cover layer 22 can be placed over the superstrate 18 for physical protection. The cover layer 22 can be made from syntactic foam. As used herein, a "highly anisotropic superstrate" is characterized by a relative permittivity tensor:

$$\bar{\varepsilon}_r(\omega) = \begin{bmatrix} \varepsilon_{xx} & 0 & 0 \\ 0 & \varepsilon_{yy} & 0 \\ 0 & 0 & \varepsilon_{zz} \end{bmatrix} \quad (1)$$

where the superstrate 18 is considered to be highly anisotropic if one of the diagonal elements in the tensor is greater than the other two by a factor of at least eight to ten.

Figure 1:
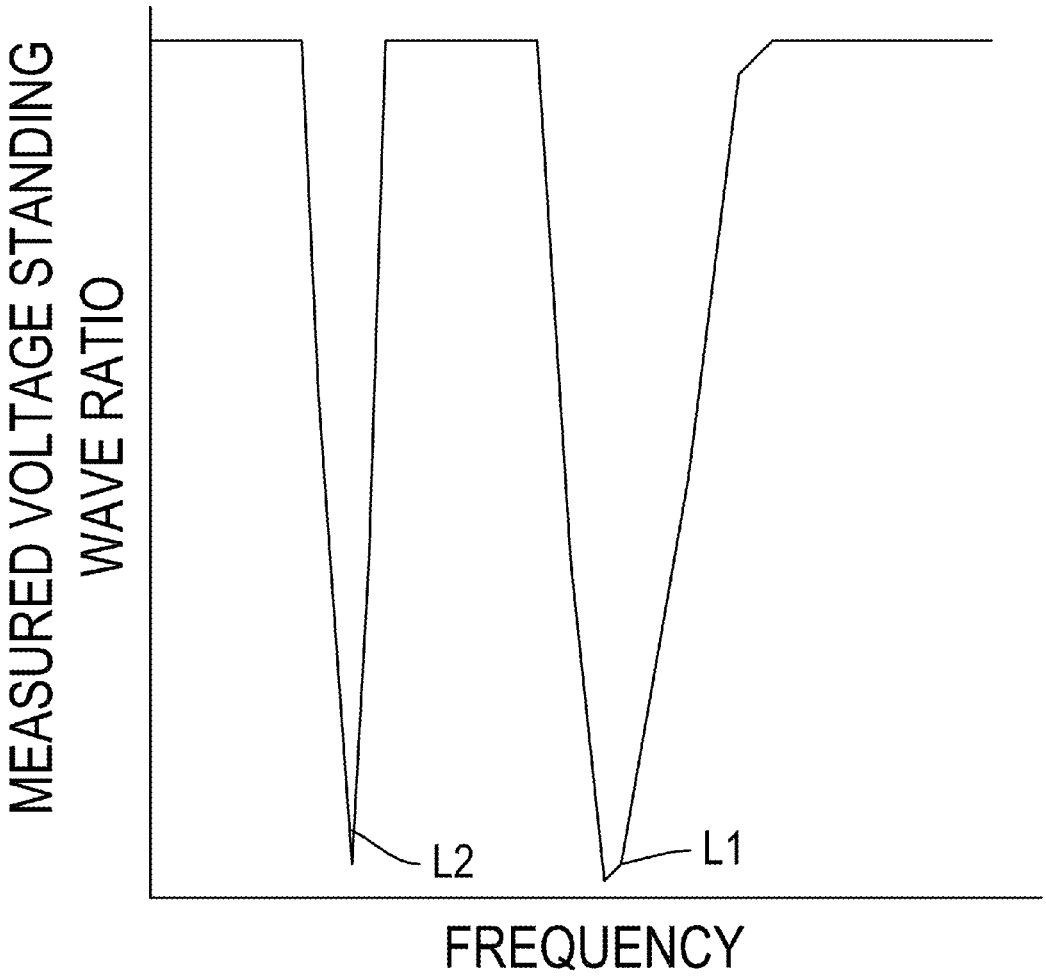
FIG. 1 is a diagram showing a measured voltage standing wave ratio (VSWR) plot for prior art patch antennas.

Without the highly anisotropic superstrate 18, an ordinary patch antenna such as 12 exhibits a resonant behavior characterized by a high Q-factor and a relatively narrow impedance bandwidth on the order of 2-6 percent. As described above, FIG. 1 shows a VSWR plot for a typical stacked patch antenna having two resonances.

The addition of the highly anisotropic superstrate 18 allows for the bandwidth of the antenna to be improved. In one exemplary embodiment of the present invention, the superstrate 18 was implemented as an array of copper stripes 24, 0.25 inch wide and 2.75 inches long, placed on a 0.25 inch thick piece of syntactic foam as shown in FIG. 3. The length-to-width ratio of the stripes 24 gives them a static polarizability of approximately 10 times that of free space, satisfying the definition of a highly anisotropic superstrate. The stripes 24 were placed 1 inch apart. Experimentation with different heights above the patch antenna 12 showed that the significant improvement in bandwidth occurred for a height, h, of 0.625 inch. This spacing was obtained by placing a block of milled polystyrene foam between the patch 12 and the syntactic foam 22 layers.

The example VSWR plot for the antenna of FIG. 2 is shown in FIG. 3. L1 indicates the resonance at the L1 GPS frequency, and L2 indicates the resonance at the L2 frequency. A broadened passband is present between about 1425 MHz and 1870 MHz (resulting in approximately a 240 MHz span). This broadened passband allows reception or transmission of frequencies other than those provided by the two microstrip patch antennas 14 and 14'.

The metallic stripes 24 forming the anisotropic superstrate were designed to be sub-resonant at the frequencies of interest for the above example. They do not achieve resonance until just above 2100 MHz and, therefore, act as polarizing shapes and not as parasitic radiators, as would be the case in a Yagi-Uda configuration or a log-periodic array.

In the exemplary embodiment shown in FIG. 2, the highly anisotropic layer can be implemented as an array of sub-resonant metallic shapes 24, resembling the letter "I". The capital and the base of the "I," identified as 26, serve as capacitive loads at the ends of the lengths of the "I". These regions 26 allow the induced current at the end of the shape 24 to be non-zero which helps the shapes perform as an anisotropic dielectric over a wider range of frequencies. Regions 26 are thus termed "capacitive load regions."

The sub-resonant shapes 24 should be oriented with respect to the microstrip patch antenna 10 relative to the current flowing on the patch antenna 10 to maximize the desired performance. This orientation should be such that induced current in the shapes 24 is maximized.

While not limited to any particular theory or mode of operation, in some embodiments, the resulting antenna operates by controlling the flow of current on the patch. The presence of the highly anisotropic superstrate and the alignment of the dominant axis of the permittivity tensor with the fields associated with the resonant mode of the patch cause a near-field interaction effect. This interaction effect alters the current distribution on the antenna, limiting the presence of standing waves on the antenna and improving the bandwidth.

The antenna of the present invention allows for a single simple antenna to cover a much wider bandwidth than it would ordinarily be able to, while also providing a modest improvement in gain. This allows the new structure to support more communications channels at greater ranges than is possible with current technology. The highly anisotropic superstrate can be easily retro-fitted to existing microstrip patch antennas to accommodate additional communications channels.

Figure 4A:
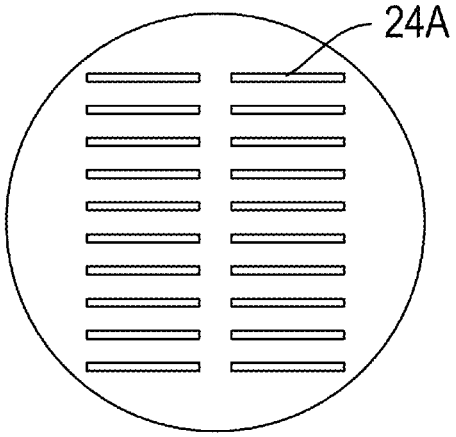
FIGS. 4A, 4B, 4C and 4D show exemplary alternative embodiments of highly anisotropic superstrates which can be used for practice of the current invention.
Figure 4B:
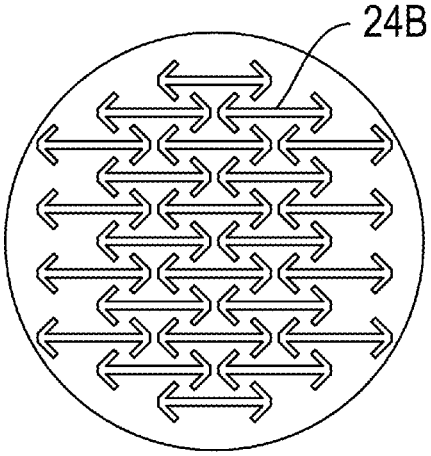
Figure 4C:
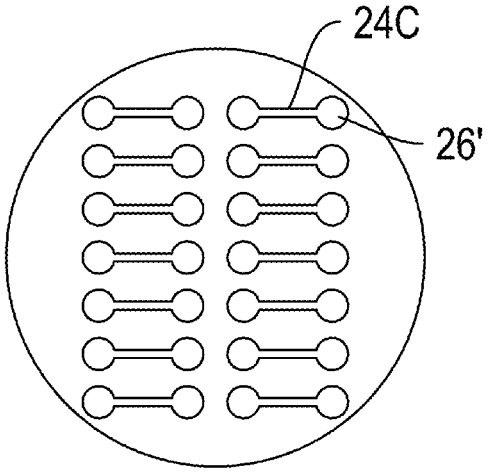
Figure 4D:
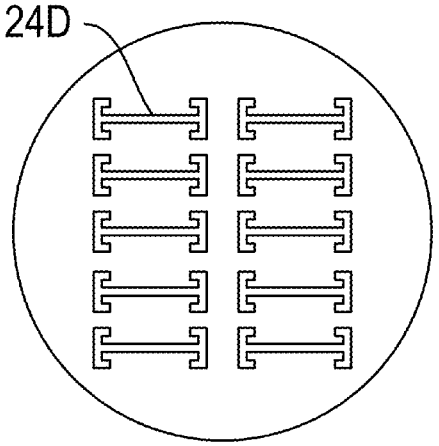

Other embodiments of the highly anisotropic superstrate are shown in FIGS. 4A, 4B, 4C, and 4D. FIG. 4A shows an embodiment having only strips 24A. FIG. 4B shows a highly packed configuration having offset strips 24B. FIG. 4C shows a configuration having enlarged capacitive load regions 26' at the end of strips 24C. FIG. 4D shows another embodiment for strips 24D. The benefits of each of these configurations can be determined by computer modeling. Thus, it can be seen that the highly anisotropic superstrate can have a variety of configurations within the scope of the current disclosure.

It will be understood that many additional changes in the details, materials, steps and arrangement of parts, which have been herein described and illustrated in order to explain the nature of the invention, may be made by those skilled in the art within the principle and scope of the invention as expressed in the appended claims.

The foregoing description of the preferred embodiments of the invention has been presented for purposes of illustration and description only. It is not intended to be exhaustive nor to limit the invention to the precise form disclosed; and obviously many modifications and variations are possible in light of the above teaching. Such modifications and variations that may be apparent to a person skilled in the art are intended to be included within the scope of this invention as defined by the accompanying claims.

What is claimed is:

1. A method for improving bandwidth and gain of a microstrip patch antenna, comprising the steps of:

forming a highly anisotropic superstrate wherein the highly anisotropic superstrate includes a plurality of conductive strips regularly disposed over a dielectric material and the plurality of conductive strips are provided with an electron dissipation region at each end of each conductive strip; and positioning said highly anisotropic superstrate at a predetermined spacing from the microstrip patch antenna on the side opposite a ground plane side of the microstrip patch antenna.

2. The method of claim 1, further comprising disposing a cover layer over said highly anisotropic superstrate.

3. The method of claim 1, further comprising disposing a spacing layer between the highly anisotropic superstrate and the microstrip patch antenna to maintain the predetermined spacing between the microstrip patch antenna and the highly anisotropic superstrate.

4. The method of claim 1, wherein the highly anisotropic superstrate is designed to be sub-resonant at a preestablished frequency of interest.

5. The method of claim 1, wherein the highly anisotropic superstrate is any material in which one element of the relative permittivity tensor of the material is greater than the other two by a factor of at least eight.

6. The method of claim 1, wherein said step of positioning further comprises orienting said highly anisotropic superstrate with respect to the microstrip patch antenna in order to maximize induced current in said highly anisotropic superstrate.

7. An antenna comprising:

a microstrip patch antenna for mounting on a ground plane; and a highly anisotropic superstrate having a predetermined resonance placed at a specific spacing above said microstrip patch antenna in the direction away from the ground plane wherein the highly anisotropic superstrate includes a plurality of conductive strips regularly disposed over a dielectric material and the plurality of conductive strips are provided with an electron dissipation region at each end of each conductive strip.

8. The antenna of claim 7, further comprising a cover layer positioned over the highly anisotropic superstrate in the direction away from the microstrip patch antenna.

9. The antenna of claim 7, further comprising a spacing layer disposed on said microstrip patch antenna in order to maintain the specific spacing between said microstrip patch antenna and said highly anisotropic superstrate.

10. The antenna of claim 7, wherein the highly anisotropic superstrate is sub-resonant at frequencies of interest.

11. The antenna of claim 7, wherein the highly anisotropic superstrate is any material in which one element of the relative permittivity tensor of the material is greater than the other two by a factor of at least eight.

12. An antenna comprising:

a microstrip patch antenna for mounting on a ground plane; and a highly anisotropic superstrate having a predetermined resonance placed at a specific spacing above said microstrip patch antenna in the direction away from the ground plane wherein said microstrip patch antenna is a stacked patch antenna having at least two patches with each patch operating at a different resonant frequency, said highly anisotropic superstrate being positioned at a specific spacing above one of said at least two patches.

13. A kit for enhancing a microstrip patch antenna comprising:

a spacing layer capable of being mounted to the microstrip patch antenna on a side of the microstrip patch antenna opposite a ground plane;

a dielectric material mounted on said spacing layer; and a plurality of conductive strips regularly disposed on said dielectric material wherein said plurality of conductive strips are each provided with a capacitive load region at each end of each conductive strip.

14. The kit of claim 13, further comprising a cover layer mounted on top of said combined spacing layer, dielectric material and plurality of conductive strips for protecting said kit from a surrounding environment.

15. The kit of claim 13, wherein the plurality of conductive strips provide a highly anisotropic superstrate material in which one element of the relative permittivity tensor of the material is greater than the other two by a factor of at least eight.

16. A method for improving bandwidth and gain of a microstrip patch antenna, comprising the steps of:

forming a highly anisotropic superstrate wherein the highly anisotropic superstrate is any material in which one element of the relative permittivity tensor of the material is greater than the other two by a factor of at least eight; and positioning said highly anisotropic superstrate at a predetermined spacing from the microstrip patch antenna on the side opposite a ground plane side of the microstrip patch antenna.

17. An antenna comprising:

a microstrip patch antenna for mounting on a ground plane; and a highly anisotropic superstrate having a predetermined resonance placed at a specific spacing above said microstrip patch antenna in the direction away from the ground plane wherein the highly anisotropic superstrate is any material in which one element of the relative permittivity tensor of the material is greater than the other two by a factor of at least eight.

18. A kit for enhancing a microstrip patch antenna comprising:

a spacing layer capable of being mounted to the microstrip patch antenna on a side of the microstrip patch antenna opposite a ground plane;

a dielectric material mounted on said spacing layer; and a plurality of conductive strips regularly disposed on said dielectric material wherein the plurality of the conductive strips provide a highly anisotropic substrate material in which one element of the relative permittivity tensor of the material is greater than the other two by a factor of at least eight.

* * * * *